US008678883B2

(12) United States Patent
Strickland

(10) Patent No.: US 8,678,883 B2
(45) Date of Patent: Mar. 25, 2014

(54) RIDING APPARATUS FOR POLISHING AND CLEANING FLOOR SURFACES

(75) Inventor: Timothy Alan Strickland, Raeford, NC (US)

(73) Assignee: Onfloor Technologies, L.L.C., Newburgh, NY (US)

( * ) Notice: Subject to any disclaimer, the term of this patent is extended or adjusted under 35 U.S.C. 154(b) by 487 days.

(21) Appl. No.: 12/811,601

(22) PCT Filed: Jan. 18, 2008

(86) PCT No.: PCT/US2008/000677

§ 371 (c)(1), (2), (4) Date: Jul. 2, 2010

(87) PCT Pub. No.: WO2009/091368

PCT Pub. Date: Jul. 23, 2009

(65) Prior Publication Data

US 2010/0291843 A1 Nov. 18, 2010

(51) Int. Cl.
*B24B 23/00* (2006.01)
*A47L 11/00* (2006.01)

(52) U.S. Cl.
USPC ..... 451/350; 15/340.4

(58) Field of Classification Search
USPC ..... 15/320, 340.1, 340.4, 401, 49.1, 50.1, 15/50.3, 52.1, 82, 83; 451/350, 353, 451, 451/442, 434, 73; 248/51, 52, 289.11
IPC ..... B24B 23/00,55/00; B08B 1/02
See application file for complete search history.

(56) References Cited

U.S. PATENT DOCUMENTS

| | | | | | |
|---|---|---|---|---|---|
| 1,980,491 | A | | 11/1934 | Mail | |
| 3,586,275 | A | * | 6/1971 | Mittelstadt et al. | 248/52 |
| 3,702,488 | A | * | 11/1972 | Kasper | 15/50.3 |
| 3,824,645 | A | * | 7/1974 | Krier et al. | 15/50.3 |
| 3,833,961 | A | * | 9/1974 | Fortman et al. | 15/50.3 |
| 3,892,003 | A | * | 7/1975 | Peabody | 15/52.1 |

(Continued)

FOREIGN PATENT DOCUMENTS

| | | | |
|---|---|---|---|
| JP | 5300858 | A | 11/1993 |
| JP | 6254020 | A | 9/1994 |
| KR | 1999 0048509 | A | 7/1999 |
| WO | WO 2006/036143 | A1 | 4/2006 |

OTHER PUBLICATIONS

HTC 1500 iT Industrialized Brochure, HTC, Inc. Professional Floor Systems, 5617 Tazewell Pike, Knoxville, Tennessee 37918, 5 pages.

(Continued)

*Primary Examiner* — Joseph J Hail
*Assistant Examiner* — Marc Carlson
(74) *Attorney, Agent, or Firm* — Reising Ethington P.C.

(57) ABSTRACT

A riding apparatus for treating a floor surface has a main steering and drive wheels and a forwardly located seat for an operator and at least one foot rest for feet of the operator. The vehicle has a polishing and cleaning deck mounted in front of the vehicle and is operably connected to the main vehicle. A clearance gap is formed between the vehicle and the polishing and cleaning deck. The at least one foot rest has a gap therebetween for providing a line of sight for the operator through the gap to view the floor surface directly behind the deck.

37 Claims, 11 Drawing Sheets

(56) References Cited

U.S. PATENT DOCUMENTS

| | | | | | |
|---|---|---|---|---|---|
| 3,942,215 | A | * | 3/1976 | Olds | 15/320 |
| 4,200,953 | A | * | 5/1980 | Overton | 15/349 |
| 4,206,530 | A | * | 6/1980 | Kroll et al. | 15/346 |
| 4,219,901 | A | * | 9/1980 | Burgoon et al. | 15/352 |
| 4,369,540 | A | * | 1/1983 | Burgoon et al. | 15/49.1 |
| 4,429,433 | A | * | 2/1984 | Burgoon | 15/320 |
| 4,571,771 | A | * | 2/1986 | Worwa | 15/319 |
| 4,624,026 | A | * | 11/1986 | Olson et al. | 15/340.4 |
| 4,654,918 | A | | 4/1987 | Cooper | |
| 5,218,732 | A | * | 6/1993 | Pettigrew et al. | 15/4 |
| 5,276,933 | A | * | 1/1994 | Hennessey et al. | 15/83 |
| RE34,822 | E | * | 1/1995 | Mattson | 180/11 |
| 5,455,985 | A | * | 10/1995 | Hamline et al. | 15/401 |
| 5,485,653 | A | * | 1/1996 | Knowlton et al. | 15/340.4 |
| 5,608,947 | A | * | 3/1997 | Knowlton et al. | 15/340.4 |
| 5,611,108 | A | * | 3/1997 | Knowlton et al. | 15/340.4 |
| 5,630,246 | A | * | 5/1997 | Knowlton et al. | 15/340.4 |
| 5,643,047 | A | | 7/1997 | Beckett et al. | |
| 5,742,975 | A | * | 4/1998 | Knowlton et al. | 15/320 |
| 5,802,665 | A | * | 9/1998 | Knowlton et al. | 15/340.4 |
| 5,832,178 | A | * | 11/1998 | Schave | 392/472 |
| 5,881,417 | A | * | 3/1999 | Knowlton | 15/52.1 |
| 5,943,724 | A | * | 8/1999 | Erko et al. | 15/49.1 |
| 5,991,953 | A | * | 11/1999 | Durenberger et al. | 15/83 |
| 5,993,563 | A | * | 11/1999 | Strickland et al. | 134/21 |
| RE36,565 | E | * | 2/2000 | Burgoon et al. | 15/320 |
| 6,105,203 | A | * | 8/2000 | Hueppi et al. | 15/320 |
| 6,108,859 | A | * | 8/2000 | Burgoon | 15/320 |
| 6,154,920 | A | * | 12/2000 | Petrole et al. | 15/349 |
| 6,202,775 | B1 | | 3/2001 | Mattson et al. | |
| 6,264,282 | B1 | | 7/2001 | Gaumont | |
| 6,343,981 | B1 | | 2/2002 | Buchanan | |
| 6,419,565 | B2 | | 7/2002 | Mattson et al. | |
| 6,450,867 | B1 | | 9/2002 | Legatt | |
| 6,575,819 | B2 | | 6/2003 | Beyersdorff | |
| 6,675,424 | B2 | * | 1/2004 | Smith et al. | 15/87 |
| 6,763,544 | B2 | * | 7/2004 | Stuchlik | 15/50.1 |
| 6,842,940 | B2 | * | 1/2005 | Christopher et al. | 15/320 |
| 6,964,081 | B1 | * | 11/2005 | Clement et al. | 15/320 |
| 6,986,397 | B2 | * | 1/2006 | Mattson et al. | 180/11 |
| 7,051,399 | B2 | * | 5/2006 | Field et al. | 15/320 |
| 7,185,397 | B2 | * | 3/2007 | Stuchlik et al. | 15/401 |
| 7,337,490 | B2 | * | 3/2008 | Goff | 15/320 |
| 7,357,700 | B2 | * | 4/2008 | Lundberg et al. | 451/353 |
| 7,640,622 | B2 | * | 1/2010 | Vankouwenberg | 15/340.4 |
| 7,665,174 | B2 | * | 2/2010 | Basham et al. | 15/52.1 |
| 7,735,186 | B1 | * | 6/2010 | Vogel | 15/320 |
| 7,958,595 | B2 | * | 6/2011 | Goff | 15/320 |
| 8,156,608 | B2 | * | 4/2012 | Field et al. | 15/319 |
| 8,234,749 | B2 | * | 8/2012 | Mitchell et al. | 15/340.3 |
| 8,262,439 | B2 | * | 9/2012 | Strickland | 451/350 |
| 2004/0074028 | A1 | * | 4/2004 | Goff | 15/49.1 |
| 2004/0154123 | A1 | * | 8/2004 | Christopher et al. | 15/320 |
| 2005/0132527 | A1 | * | 6/2005 | Pedlar et al. | 15/340.3 |
| 2005/0223514 | A1 | * | 10/2005 | Stuchlik et al. | 15/320 |
| 2005/0235453 | A1 | * | 10/2005 | Vankouwenberg | 15/340.4 |
| 2006/0282975 | A1 | * | 12/2006 | Basham et al. | 15/320 |
| 2007/0157417 | A1 | * | 7/2007 | O'Hara | 15/320 |
| 2007/0264917 | A1 | * | 11/2007 | Lundberg et al. | 451/353 |
| 2008/0078041 | A1 | * | 4/2008 | Mitchel et al. | 15/50.3 |
| 2009/0023369 | A1 | * | 1/2009 | Thysell | 451/350 |
| 2009/0078281 | A1 | * | 3/2009 | Goff | 134/6 |
| 2009/0094784 | A1 | * | 4/2009 | Pedlar et al. | 15/340.1 |
| 2010/0136890 | A1 | * | 6/2010 | Strickland | 451/73 |
| 2010/0197210 | A1 | * | 8/2010 | Goldberg et al. | 451/353 |
| 2011/0011988 | A1 | * | 1/2011 | Shepard et al. | 248/52 |

OTHER PUBLICATIONS

Written Opinion and International Search Report for PCT/US2008/000677 dated Oct. 15, 2008 (12 pages).

* cited by examiner

RIDING APPARATUS FOR POLISHING AND CLEANING FLOOR SURFACES

TECHNICAL FIELD

The field of this invention relates to a riding apparatus for polishing and cleaning a floor surface.

BACKGROUND OF THE DISCLOSURE

Concrete floors are common today in large, medium and small retail stores, manufacturing and production facilities, warehouses, automotive shops and service centers, shopping centers, garages, commercial buildings and residential basements. Concrete is also common material for sidewalks. The strength of concrete provides the durability and rigidity required in these environments. However, the exterior surface of a newly poured concrete floor, once dry, is often rough, uneven, and provides a dull appearance. Furthermore, when left in this unfinished state, the concrete will inherently produce dust particles from the constant scuffing, whether it is from foot traffic or wheeled traffic that can build over time and become a nuisance to those who work and/or live in these environments. It is well known to first grind the concrete surface and then coat the surface with a sealant to smooth the concrete, to make it aesthetically pleasing to the eye, and to help reduce dust particles.

In the grinding process, commonly used grinding machines usually have a planetary or direct drive belt and gear drive systems containing a plurality of circular drive plates mounted to gears on a deck with removable abrasive pads attached to each drive plate. These grinding machines may also be referred to as grinding, honing, abrasive or abrading machines. They may also be referred to as polishing and cleaning machines. Hereinafter, the term "polishing and cleaning" is used in the generic sense and includes abrasion, scrubbing, sweeping, honing, grinding, sanding and/or abrading, cleaning and polishing. These types of machines can also be referred to as an apparatus for treating a floor surface. The term "treating a floor surface" as used herein can mean either cleaning, abrading, sanding, scrubbing, polishing, or honing a floor surface. These polishing and cleaning machines may typically be electric walk along machines where an operator stands behind the machine and pushes it along at a certain pace such that the deck sufficiently grinds, abrades, hones, polishes and or cleans the floor surface. These walk along configurations can produce fatigue in the operator and the operators position behind the machine prevents a clear view of the floor surface until the floor surface passes under the operator's feet well behind the deck. Thus if a spot on the floor is missed or not adequately prepared, the operator may need to back up a distance to redo the spot.

Riding polishing and cleaning machines are known but have had certain drawbacks. Firstly, some are large using standard tractor bodies powered by internal combustion gas, diesel or propane engines. The exhaust from such gasoline, diesel or propane engines makes it less desirable to use within an interior confined space. The use of internal combustion engines and hydraulic drive systems also introduces the significant probability that there may be leakage of oil, petroleum based or synthetic based lubricant or fluid onto a porous cured top layer of concrete or an even more porous substrate. Any leakage or spillage of oil, gasoline diesel fuel or grease onto the surface will be readily and permanently absorbed into the concrete and leave a permanent stain that will never yield a proper polished surface free of stains. Furthermore the oil, grease, or lubricant can contaminate the cutters or other grinding, and polishing pads or tools.

In addition, many of these machines are quite large and the operator has either no view or a poor view of the floor after the deck passes over. Thus, on-the-spot quality control for just prepared floor surface is extremely difficult.

Riding polishing and cleaning machines have had awkward configurations with either rear positioned seating or enclosed cab seating for the operator which blocks his view. Other machines have open high precarious seating which can make the operator feel vulnerable or unsafe in such a high open position from the floor.

Electric powered riding polishing and cleaning machines are also commercially utilized. While the wheels and vehicular controls are powered by on board rechargeable batteries, the proper high pressure, torque and speed power needed for the cleaning and abrasive deck is too demanding for present day battery technology so the electric power is provided through a power cord from a remote power supply. The power cord often intrudes in the way of the apparatus wheels and deck particularly when the ride on machine is heading in the direction back toward the power supply. A significant amount of time is spent by the operator manually getting off the vehicle to move the cord out of the way of the vehicle.

Another difficulty with the known riding polishing and cleaning machines is the difficulty in changing the grit pads or cutters when the grit pads or cutters become worn. Replacing the worn pads or cutters, or in some cases replacing the entire deck is both burdensome and time consuming to the user.

Another common problem is dust control. Often the vacuum system at the deck picks up only about 80 percent of the generated dust. The remaining dust must be picked up by a sweeping deck. Previous sweeping decks have been an integral part of the ride-on apparatus's chassis. As such when uneven flooring or an obstacle is encountered, the sweeping apparatus can be jammed or not provide the necessary ground clearance.

What is needed is a riding polishing and cleaning apparatus that allows an operator a relatively low seating position and have direct view of the floor surface behind the cleaning and abrasive deck. What is also needed is a riding polishing and cleaning apparatus that has a power cord handling system. What is also needed is a riding polishing and cleaning apparatus that has a sweeping deck that is vertically adjustable with respect to the apparatus chassis. What is also needed is a riding polishing and cleaning apparatus that has an easily liftable, tiltable and disengageable polishing and cleaning deck.

SUMMARY OF THE DISCLOSURE

In accordance with one aspect of the invention, a riding apparatus for treating a floor surface has a main motorized vehicle with steering and drive wheels and a forwardly located seat for an operator and left and right foot rests for feet of the operator. A polishing and cleaning deck is mounted in front of the vehicle and is operably connected thereto to be moved thereby with a clearance formed between a front of the main motorized vehicle and a rear of the polishing and cleaning deck. The left and right foot rests are spaced apart to form a gap therebetween with the gap and the clearance aligned with the seat located for providing a line of sight for the operator through the gap and clearance to see the floor surface between the polishing and cleaning deck and the main motorized vehicle.

Preferably, the vehicle has a low profile rear body section positioned to have its upper surface located below the normal eye level of the operator when the operator is seated on the seat such that a full 360° field of vision to the rear is directly available to an operator. The upper surface of the vehicle body desirably is sloped downwardly from a position immediately behind the seat to a rear end of the riding apparatus.

According to another aspect of the invention, an upper positioned swing arm is pivotably connected about a substantially vertical pivot axis point behind and above the operator seat and constructed to horizontally swing to the left and to the right of a rearwardly extending position down a center line of the main motorized vehicle. The swing arm has a length more than one-half the width of the vehicle such that the swing arm has sufficient length to extend a restrained section of the cord beyond a left and right side of the vehicle when swinging to its full left or right position. The power cord has its restrained section near a distal end of the swing arm and operably connected to the polishing and cleaning decks for transferring electric power to the deck. Preferably, the pivot is constructed to provide the swing arm to swing approximately 90° to either side of the centered rearwardly extending position.

In one embodiment, the vehicle has two front wheels and a rear wheel. The rear wheel is steerable and operably connected to an electric motor for driving the vehicle. The electric motor is powered by an on-board battery source that is directly and continuously rechargeable via the vehicle's main onboard power supply when powered on and during vehicle operation.

It is desirable that the polishing and cleaning deck is pivotably connected along a generally horizontal laterally extending axis to the vehicle through a front distal end of a raisable link arm such that the deck can be pivoted to a generally vertical position to expose the underside of the deck when the deck is in a raised position off of the floor surface. Preferably the link arm has a notch at a distal end and a closable latch for being movable between a closed position to retain the deck to be pivotably mounted to the link arm and an open position to allow the link arm to vertically move to disengage from the deck when in its lower floor engaging position.

According to another aspect of the invention, a riding apparatus for treating a floor surface has a sweeping deck mounted under the vehicle behind the polishing and cleaning deck through a linkage that provides relative vertical movement with respect to the vehicle. The sweeping deck includes a motorized brush for sweeping a floor, a hopper for receiving dust from the brush and a castor wheel for providing a lower stop for the sweeping deck. Preferably, a vacuum system is operably connected to collect dust from both the polishing and cleaning deck and the hopper in the sweeping deck.

The linkage system includes a lifting actuator to raise the sweeping deck and when in a floor engaging position allows the sweeping deck to automatically lift, i.e. float upwardly, with respect to the vehicle body when encountering a raised floor surface or obstacle under the vehicle body wheels to prevent the sweep deck from jamming the roller brush.

In accordance with another aspect of the invention, a power cord handling system for a riding apparatus with a polishing and cleaning deck for treating a floor surface powered from a power cord includes an upper positioned swing arm pivotably connected to the riding apparatus about a substantially vertical pivot axis to horizontally swing the swing arm to the left and to the right of a rearwardly extending position when a torque is exerted thereon. The power cord has a restrained section near a distal end of the swing arm and operably connected for providing electric power to the polishing and cleaning deck. The swing arm has a length more than one-half the width of the vehicle such that the swing arm has sufficient length to extend beyond a left and right side of the riding apparatus when swinging to its full left or right position to position the restrained section of the power cord beyond the respective left and right side of the vehicle. A stop mechanism prevents the swing arm from further horizontal rotation beyond its full left and full right position. A remote power cord reel assembly allows the power cord to be unreeled therefrom when the riding apparatus is moving away from the reel assembly and constructed to substantially take up slack of the power cord when the riding apparatus is moving toward the reel assembly.

Preferably the reel assembly having a spring loaded rotatable reel and a weighted frame to stabilize against horizontal torque force exerted by the spring loaded reel.

BRIEF DESCRIPTION OF THE DRAWINGS

Reference now is made to the accompanying drawings in which.

DETAILED DESCRIPTION OF THE PREFERRED EMBODIMENT

Figure 1:
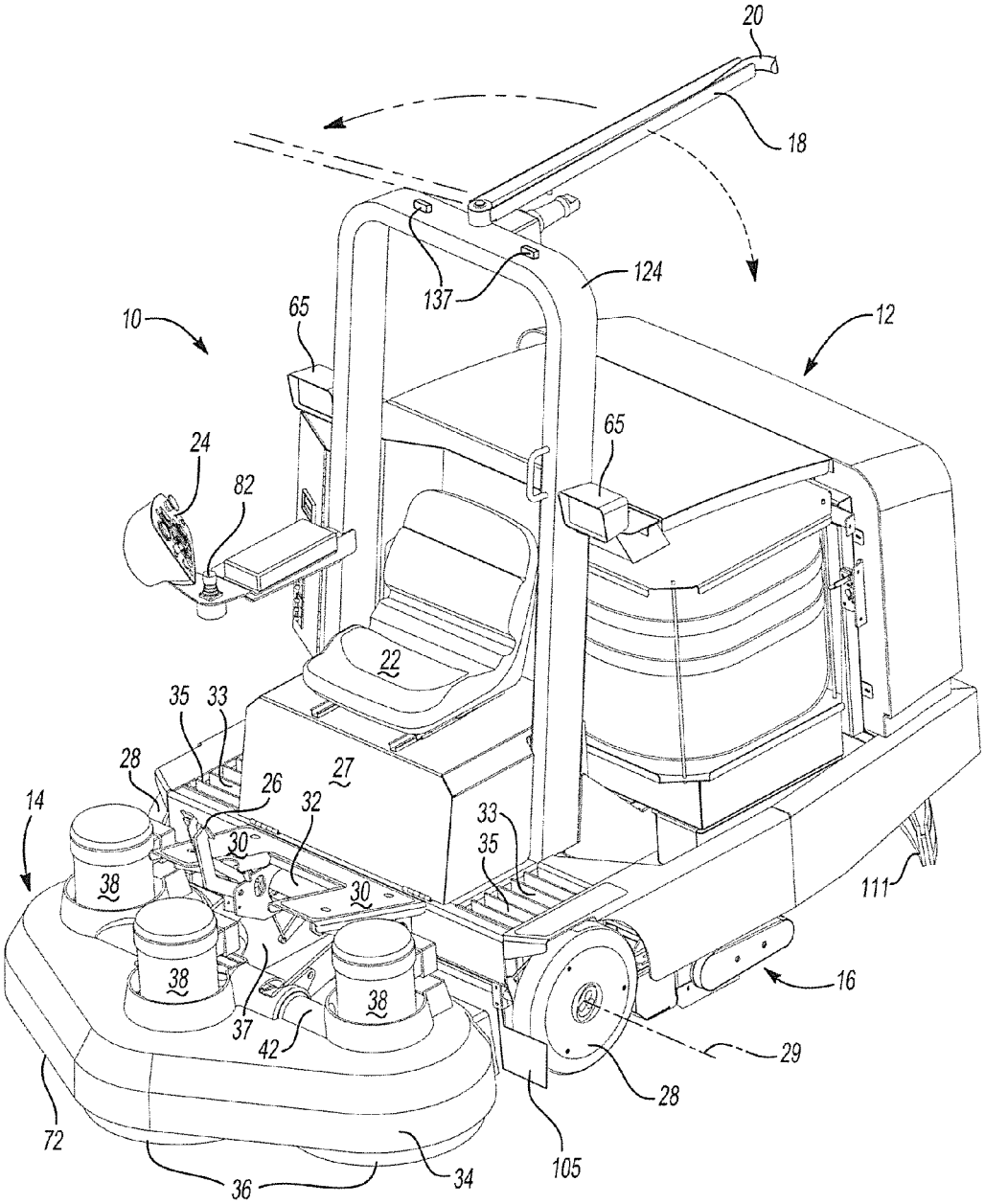
FIG. 1 is a top perspective view showing a riding polishing and cleaning apparatus according to one embodiment of the invention with a vehicle panel removed to expose the interior.

Referring now to FIG. 1, a riding polishing and cleaning apparatus 10 has a battery operated main vehicle body 12, a forwardly positioned polishing and cleaning deck 14, a sweeping deck 16, and a swing arm 18 for a power cord 20.

Figure 3:
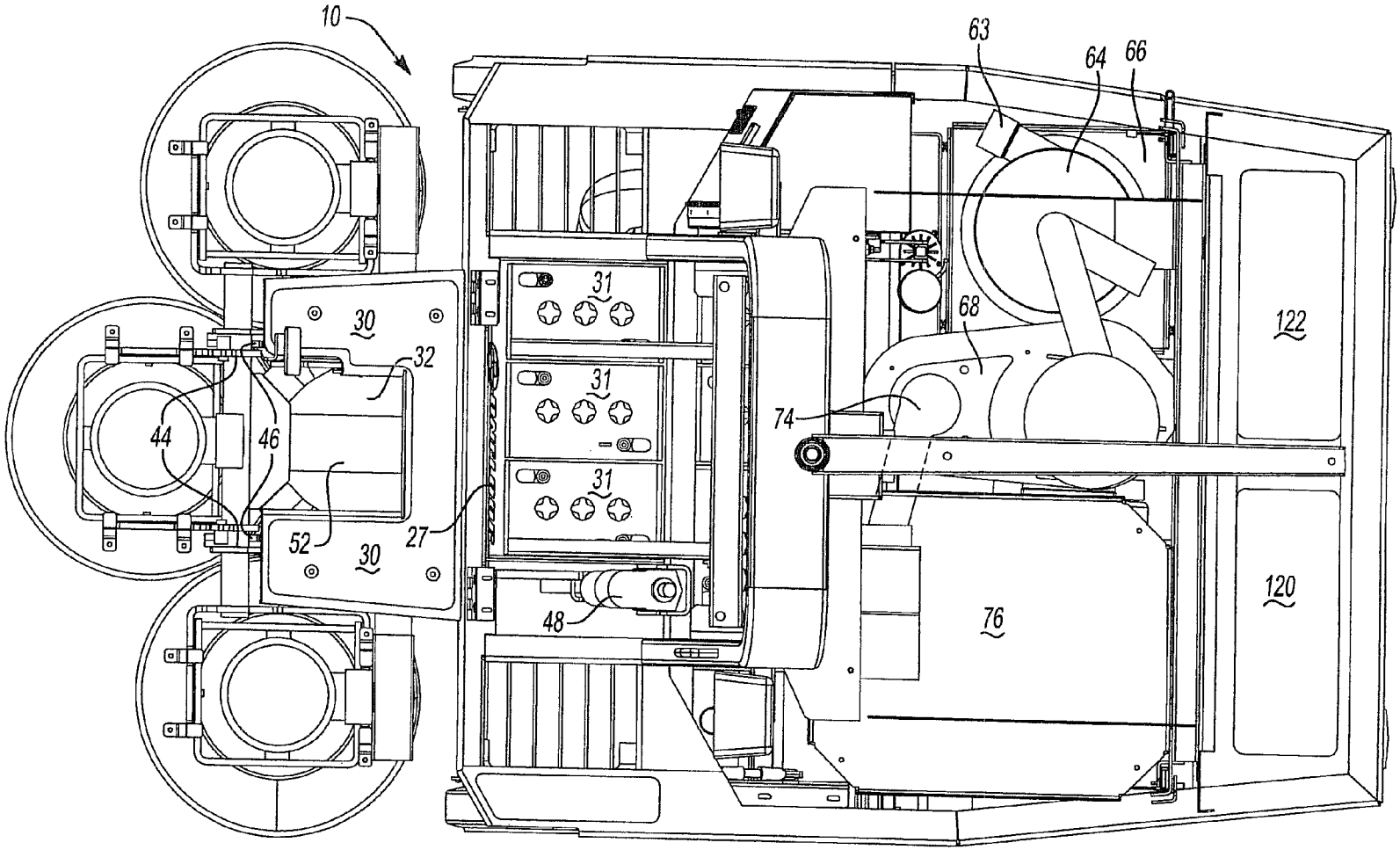
FIG. 3 is a top plan view of the riding polishing and cleaning apparatus shown in FIG. 1 with the deck shell and vehicle panels removed to show the interior components.

The vehicle body 12 has a forward positioned operator seat 22 with controls 24 readily positioned for hand operation to control speed, direction and other needed vehicle and deck functions and foot controls 26, for example a brake and transmission clutch. The seat 22 is positioned over the electric batteries storage container 27. The electric batteries 31 stored in container 27 as shown in FIG. 3 can be a conventional lead acid type or any state of the art battery that powers the vehicle for motion. The seat 22 is also aligned above an axis 29 defined by the two front wheels 28.

Two foot rests 30 are positioned apart to rest the operator's left and right feet. A gap 32 is formed between the two foot rests 30. The gap 32 is aligned over the clearance 37 between the center section of the polishing and cleaning deck 14 and the main vehicle body 12 to provide a line of sight to the floor surface. Side vented windows 33 to the inside of the front wheels 28 also provide a line of sight to the floor surface behind the left and right side sections of the front deck 14. The side vented windows 33 have a support grate 35 that can be used as a single step for an operator 62 to access seat 22.

Figure 2:
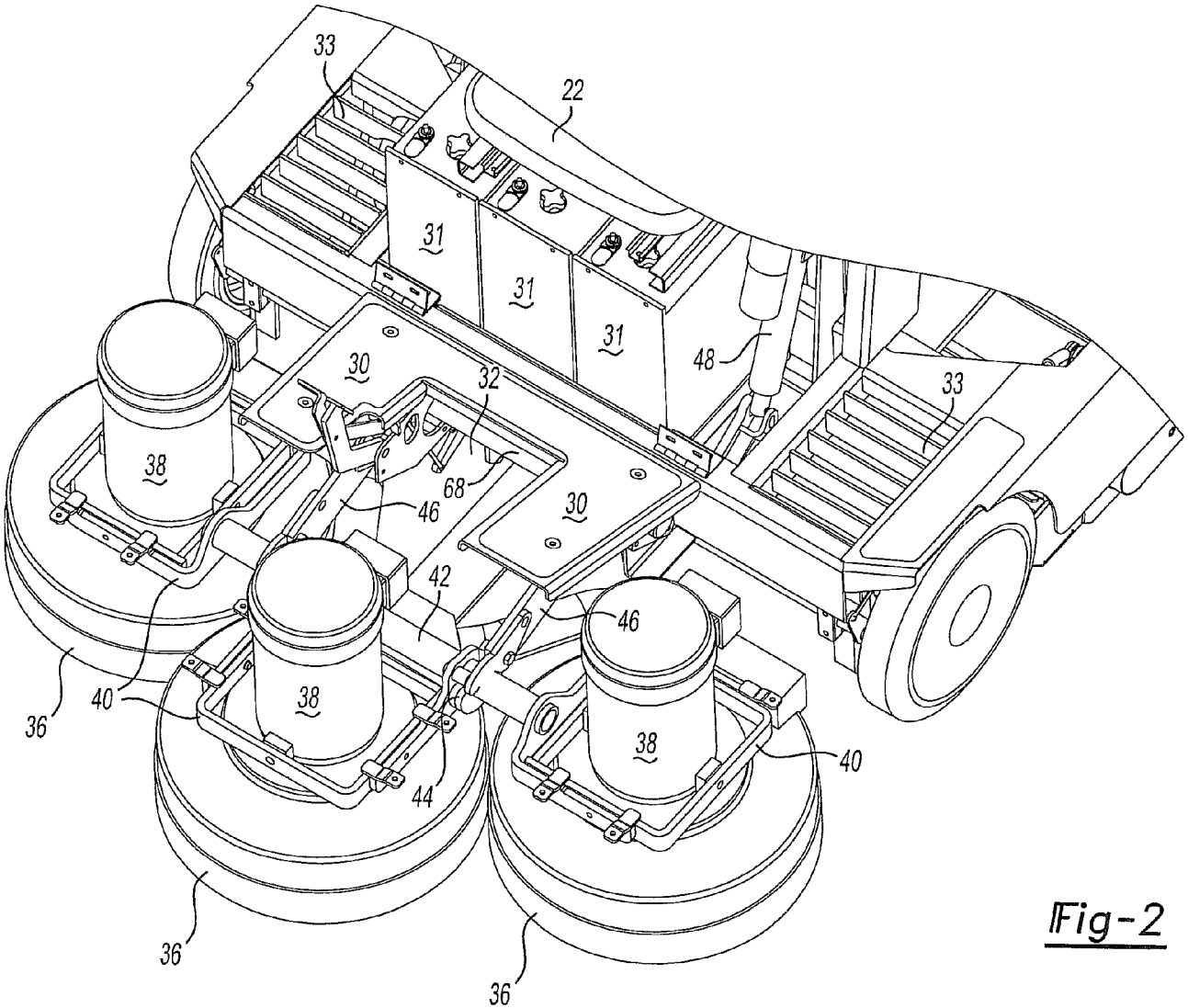
FIG. 2 is an enlarged fragmentary view with the deck shell removed for illustrating in more detail the polishing and cleaning deck and its mounting frame shown in FIG. 1.
Figure 4:
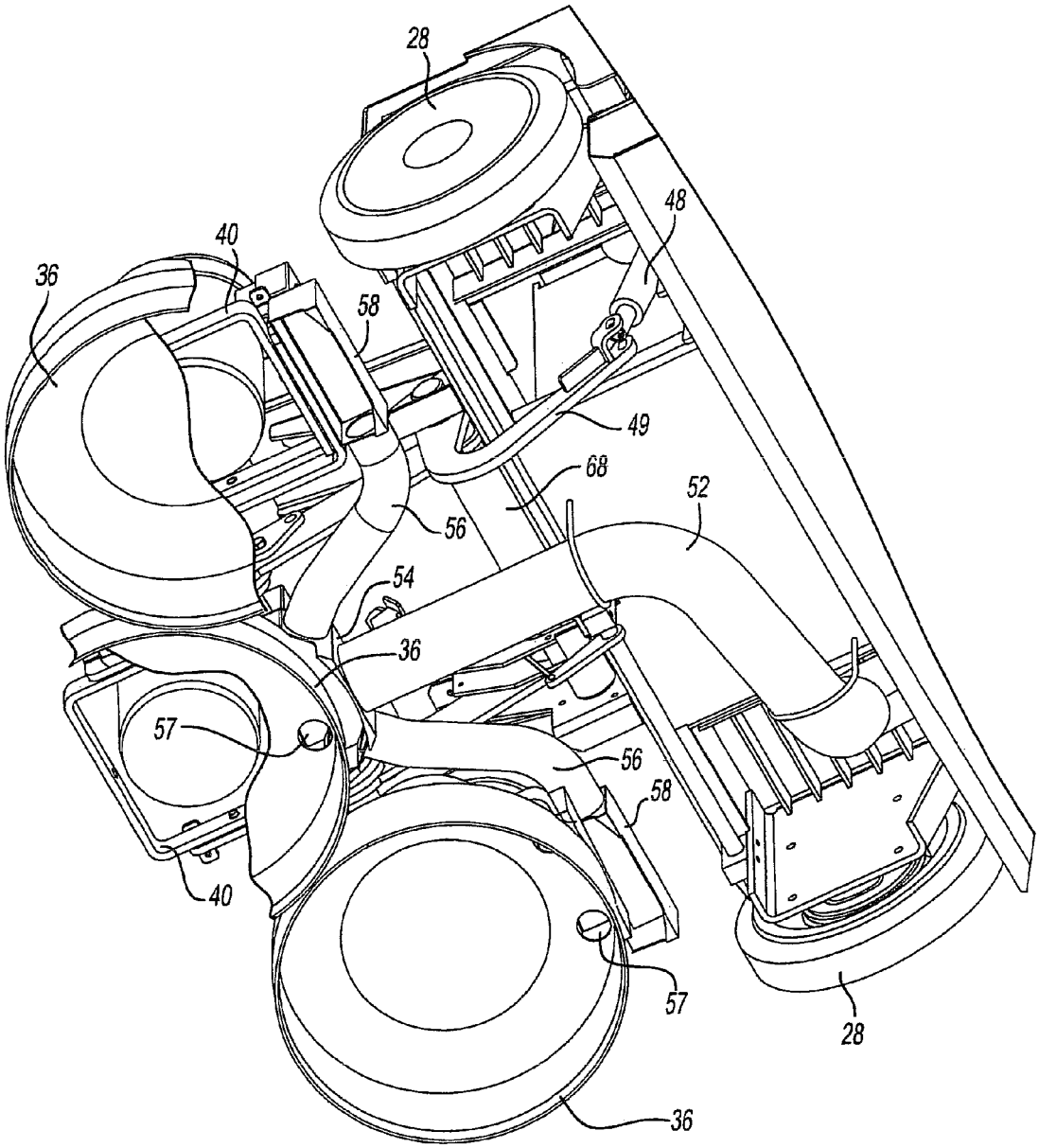
FIG. 4 is a fragmentary bottom perspective view of the polishing and cleaning deck illustrating the vacuum hose intakes.

As shown more clearly in FIGS. 2, 3, and 4, three cleaning and abrasive heads 36 that are operated by electric motors 38 are housed within shell 34. The electric heads 38 are powered from a remote power source delivered through a power cord as described later. The heads 36 are mounted to a deck frame 40. The deck frame has a horizontally disposed round bar 42 which engages an operable claw end 44 of two parallel arms 46.

Figure 5:
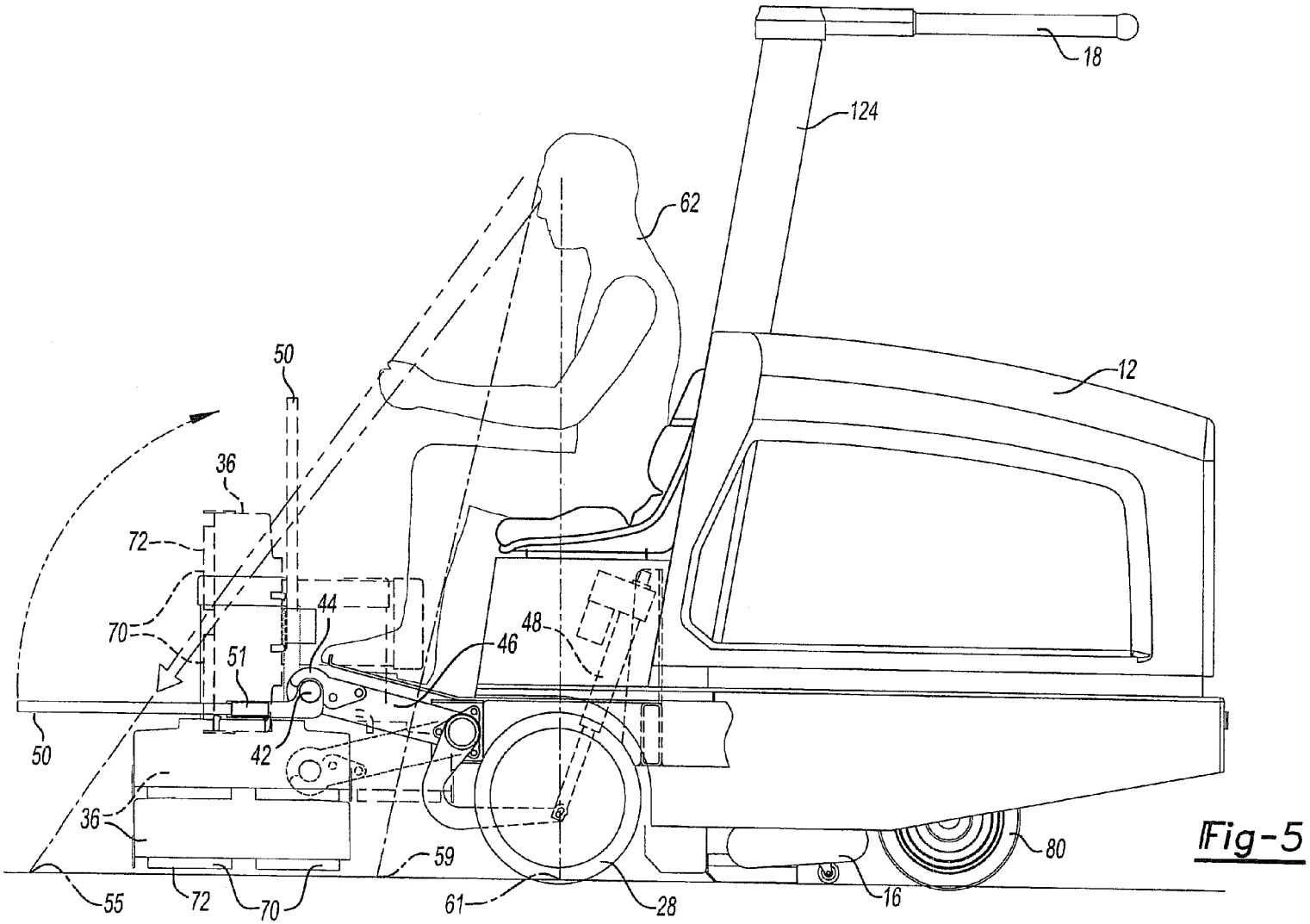
FIG. 5 is a side elevational view of the riding polishing and cleaning apparatus illustrating a person's field of vision and the lifting and tilting of the front deck to expose the underside of the polishing and cleaning deck.
Figure 6:
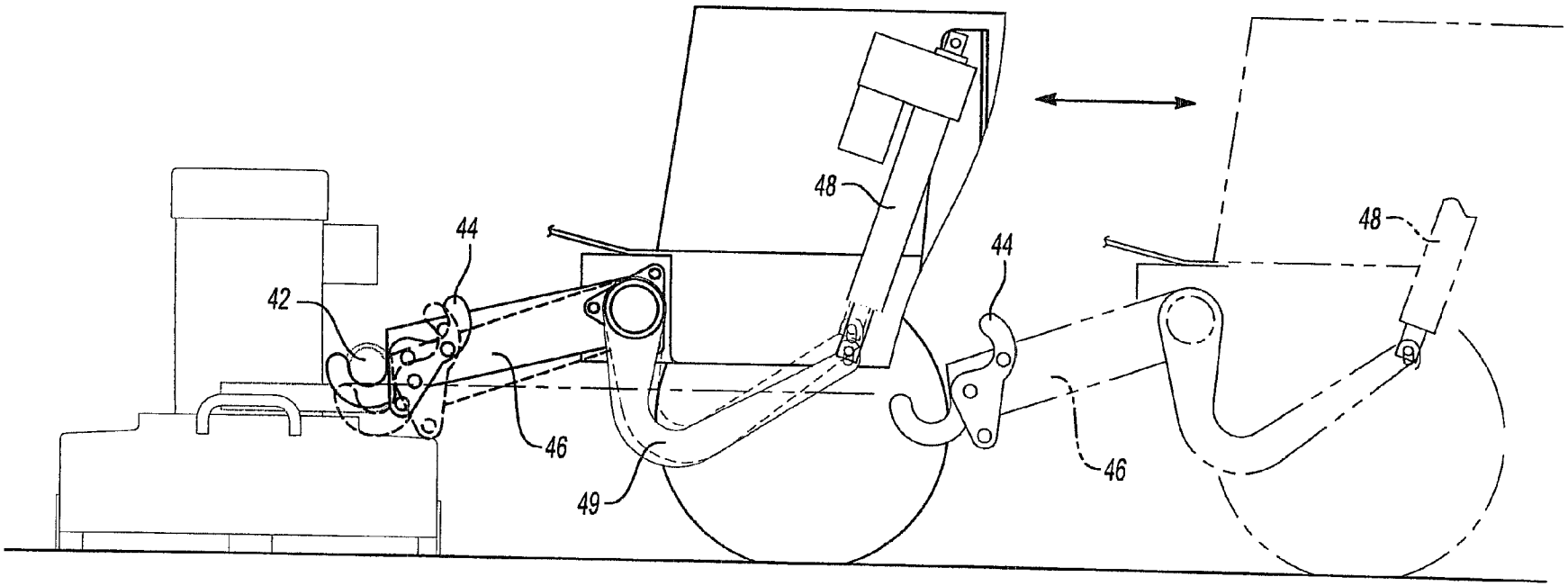
FIG. 6 is an enlarged side elevational view illustrating the polishing and cleaning deck's connecting linkage to the main vehicle body of the riding sander.

As shown in FIG. 5, the arms 46 are operated and powered to move between a lower operating position and raised service position i.e. lower the deck 14 onto the floor surface and also to raise the deck 14 respectively. The arms 46 may be power operated for example by hydraulic cylinders 48 through a linkage 49 between the raised and lower positions as shown in FIG. 6. In addition, the hydraulic cylinder 48 can provide extra force in the lower position to add some of the weight of the vehicle 12 onto the deck 14 when more downward force is needed during the more aggressive grinding and abrasive operation of the deck 14. For example, the cylinders 48 can lift the front wheels 28 off of the floor to add some of the weight of the vehicle 12 onto the deck 14. It is foreseen that hydraulic cylinder 48 can be replaced by other types of power mechanisms, such as electrically driven devices. This use of downward force from the main vehicle eliminates the need of external weight and its associated cumbersome carrying, storing and handling.

Furthermore, the frame 40 can pivot within the claw end 44 to pivot to deck 14 to a service position shown in FIG. 5 to expose the disc pad under each head and access the underside of all the disc heads 36. A removable handle 50 may engage a horizontal grip tube 51 so that an operator can manually pivot the deck 14. One of several types of locking devices may be engaged to keep the deck 14 in this servicing position. It is noted that the use of the single lever 50 rotates the entire deck including all three heads 36 in one pivoting motion. The deck is raised sufficiently high to assure that the side heads 36 also clear the floor during this pivoting motion. Optionally, the round tube or bar 42 may have a cam lever thereon to be operated by a hydraulic cylinder or linear actuator for power pivoting of the deck. A linear actuator when used can double as a lock due to its worm gear ratio inherently designed therein.

As shown in FIG. 6, the deck 14 can be disengaged from the vehicle and arms 46 by opening of the claw end 44, further lowering of the arms 46 to clear the claw end 44 from the round bar 42 and moving the vehicle 12 rearwardly to leave the deck 14 on the floor. Before the vehicle rearward movement, the flexible central vacuum hose 52 can be disconnected as well as any quick connect wiring plugs that provide the power to the electric motors 38. Reversing the process, reattaches the claw end 44 with the bar 42. The claw end 44 can be retained in the closed position by a standard lock mechanism for example a clevis pin and retaining hairpin style clip. Alternatively, the claw end 44 opening and closing can be automated and further expedited for example by use of a pneumatic cylinder, electric linear actuator or a remotely operated manual linkage. In this way, the vehicle 12 quickly and can easily switch decks 14 when desired i.e. when decks have different grit pads 70 thereon or switching from a grinding and/or polishing deck to a cleaning deck. In other words, a second deck 14 may be on the floor surface ready to be engaged with the main motorized vehicle 12 after the first deck 14 is disengaged.

The round bar 42 is positioned by locating it at or near the fore and aft center of gravity of the deck 14. The round nature of the bar 42 also allows the deck 14 to pivot thereabout to automatically become horizontal. The front claw 44 provides sufficient clearance for the bar 42 to rotate therein when the claw is in the closed and locked position. As shown with the three heads 36 as positioned, the bar is behind the electric motor 38 of the center head and slightly in front of the electric motors 38 of the left and right heads 36 to achieve the center of gravity balance.

The hydraulically operated arms 46 are operated by a hydraulic cylinder 48 through linkage 49 that pivots the arms 46 about a rear connection bar 68 which lifts the entire deck 14 including the round bar 42, all the heads 36, and frame 40. Furthermore as shown, easy access to abrasive pads or cutters 70 may be further enhanced by pivoting of the deck about round bar 42 to place the operating underside 72 of the deck 14 in a forward direction. The easy accessibility allows for ease in changing the pads 70 when needed.

Referring to FIG. 4, the central vacuum hose 52 is connected to a vacuum manifold 54. Vacuum hoses 56 connect the central manifold 54 to two similar side manifolds 58. The manifolds 54 and 58 connect to the respective heads 36. The central vacuum hose 52 leads to the vacuum system to the rear of the operator as described later. The vacuum manifolds 52 and 58 are in communication with the interior of heads 36 through apertures 57.

As shown in FIG. 5, an operator 62 is seated in a forward position at the front end of the vehicle 12 and behind the deck 14. The vehicle is constructed to provide a greatly enhanced view of the floor surface by operator 62. Firstly, by being up front, the operator 62 has a much better angle to see the floor surface just before it goes under the deck as indicated at 59. Secondly, the clearance 37 between the rear of the deck 14 and the front of the vehicle 12 and the gap 32 between the foot rests 30 allow for visual viewing of the floor surface after the deck passes over behind the center abrasive head 36 to the area 59 of the floor. Thirdly, the windows 33 allow the operator 62 a line of sight to each area 61 of the floor behind the other two side heads 36 inside of wheels 28. This visibility just behind all three heads provide real time monitoring of the floor surface and any defects that are discovered can be immediately corrected. To aid in illuminating the floor, optional lights, such as lamps 65 and others (not shown) may be installed on the vehicle and aimed to these floor areas 55, 59 and 61.

In addition, the low profile of the body 12 well below the operator's head allows for rear visibility without the need of mirrors to facilitate good vision at the corners during turns and also during rearward motion when necessary. The low profile of the entire vehicle 12 provides for the seat 22 to be relatively close to the floor but still provide a commanding view fully about the vehicle. Furthermore, the low profile provides a security measure and a feeling of safety for the operator 62 as compared to high open cockpit positions found in the prior art. For example, it is feasible to obtain the seat cushion to be 35" to 45" high off of floor.

As shown in FIG. 5, the vehicle has a single rear wheel assembly 80 that is both powered and steerable to maneuver the vehicle 12. The use of joystick 82 on the front control panel 24 shown in FIG. 1 can be used to steer the rear wheel. Alternatively a conventional steering wheel can also be used. One suitable drive wheel is sold under the Metalrota trademark and can give 180 degree steering or turning capability i.e. 90 degrees in each direction.

Dust control is accomplished by several separate systems. The first vacuum system picks up dust inside the bowls of grinder heads 36 through the apertures 57 and through hoses 54 and 52 which as shown in FIG. 3 is operably connected to an inlet 63 of first stage centrifugal separator 64 which functions as a precleaner that spins the heaviest solids into a disposable bag lined container 66. The outlet of the centrifugal separator leads to a four stage vacuum motor 68 whose outlet 74 is connected to an envelope filter bag 76 which filters the remaining smaller particles before the air is expelled out through the filter media to the ambient atmosphere. The filter bag 76 has filter media therein which can be cleaned by a backflush system for reversing air flow in a forceful and pulsing fashion to unplug or clean the filter media. This can be accomplished for example by an electrically driven air pump pressurizing an accumulator tank. A dump valve is electrically coupled to a 5 or 6 position switching valve which can be plumbed to the individual bag type filter media. A timer is used to time the dump valve or a pressure switch is used to empty the accumulator tank.

Figure 7:
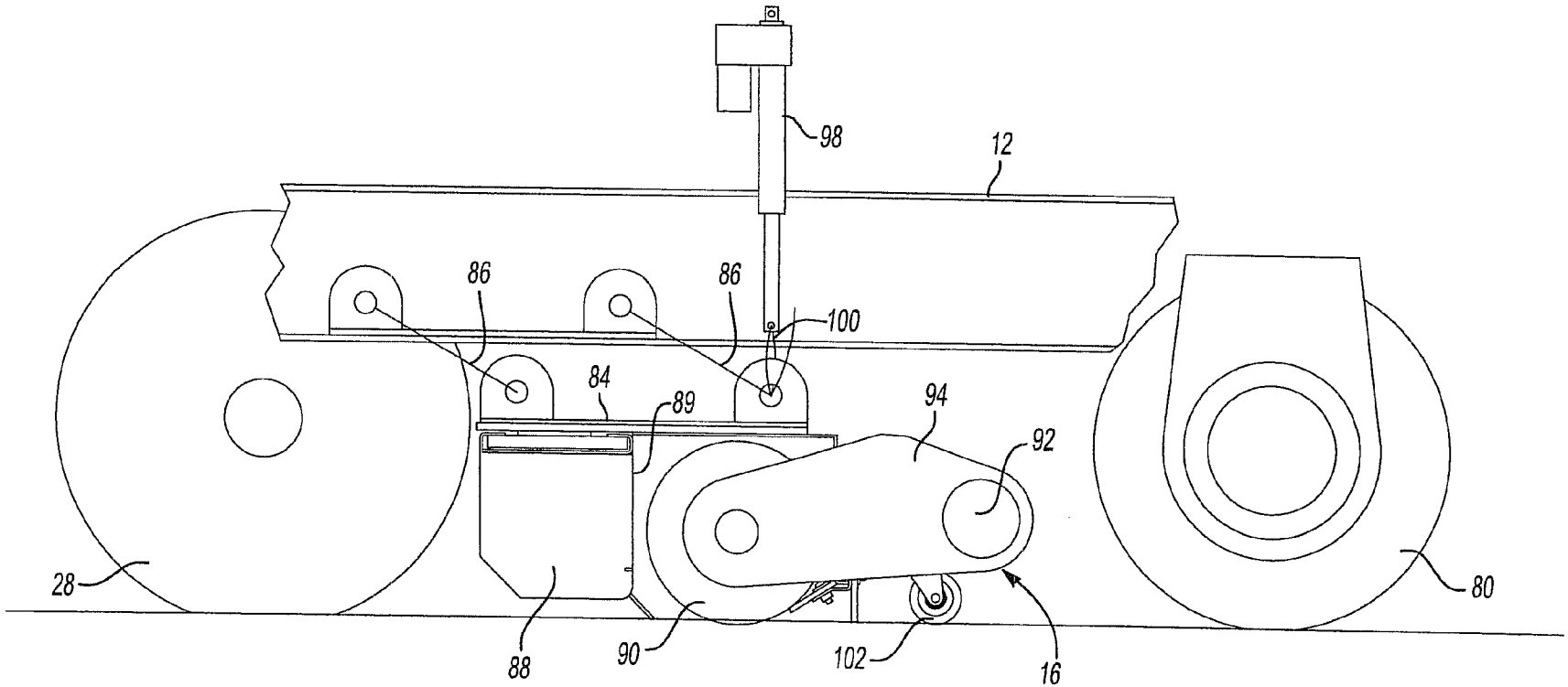
FIG. 7 is a fragmentary side elevational view of the floating sweeping deck under the main vehicle body.
Figure 8:
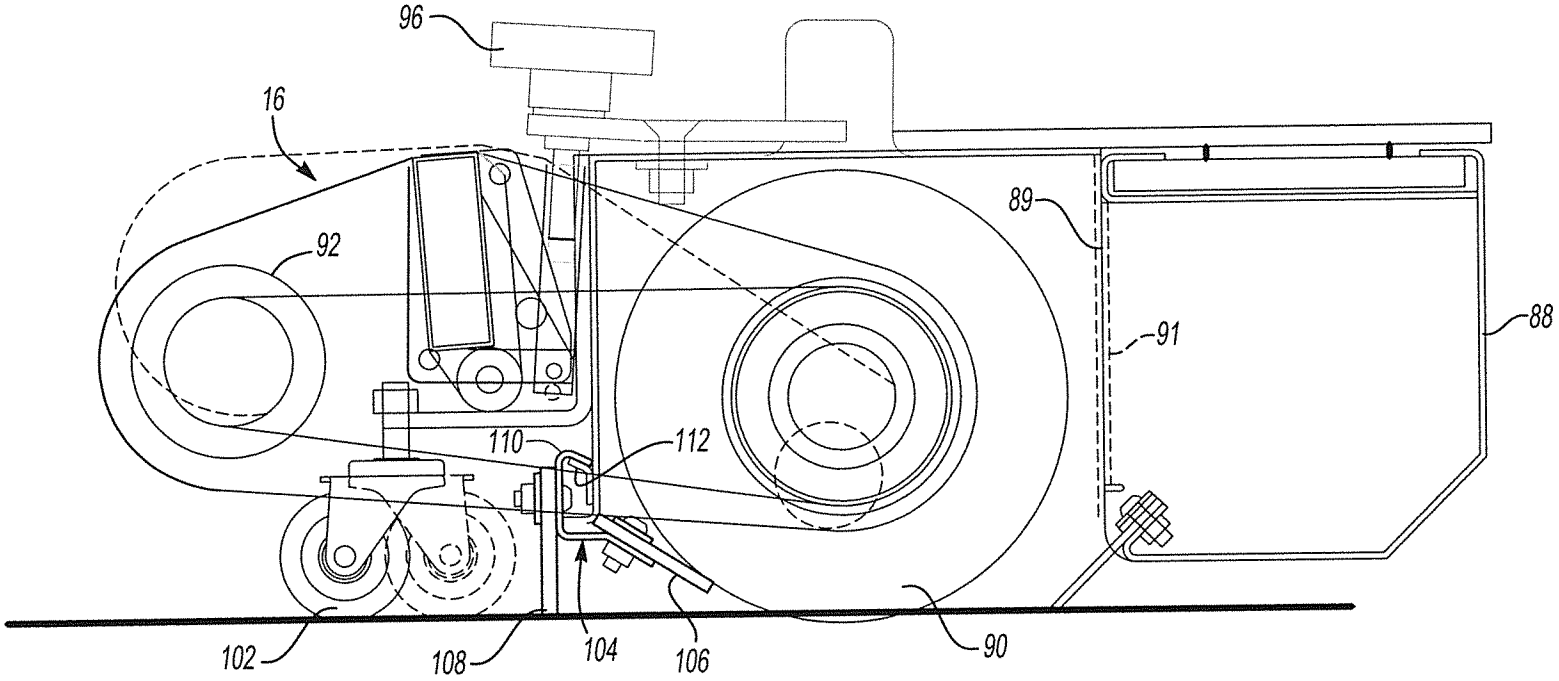
FIG. 8 is an enlarged elevational view from the other side of the sweeping deck.

A second dust controller includes a sweeping deck 16 suspended under the vehicle 12. As shown more clearly in FIGS. 7 and 8, the sweeping deck 16 includes a frame 84 that is suspended via cables 86 or parallel rods to the vehicle 12. A hopper 88 is mounted under the frame and has an open side 89 facing a powered roller brush 90. The hopper 88 is also connected to the vacuum system to evacuate the dust therein to the vacuum system as described above and to maintain the hopper in a condition for receiving more dust from the roller brush. The size of the hopper can thus be significantly reduced to an amount correlated with higher CFM (Cubic Feet per Minute) rated vacuums. The roller brush 90 is powered by a motor 92 mounted to the broom arm 94 and belt driven thereby. The broom arm 94 is pivotably adjustable through a wear adjustment knob 96 to maintain proper contact of the brush to the floor as the brush wears and its diameter decreases as shown in phantom in FIG. 8. The open side 89 may be closed by a door panel 91 when the apparatus is wet scrubbing to prevent wet slurry from entering the hopper 88.

The entire sweeping deck can be lifted by an actuator 98 that is connected to the frame 84 through a non-rigid cable 100. The non-rigid connection allows the rear caster 102 to act as a stop. The non-rigid cable 100 prevents the actuator from overloading the casters or the deck would fail to be in the proper position to the floor. In addition, should a collision object be encountered by the sweeping deck, the non-rigid link 100 allows the entire sweep deck to float over the collision object and thereby minimize damage. Alternatively, the non-rigid cable 100 may be replaced by a rigid linkage that is connected via a vertical oriented slot that allows relative vertical movement between the linkage and either the actuator or the sweeping deck 16 to accomplish the same effect. Furthermore, the sweeping deck 16, if damaged, can be easily removed from the existing machine for ease of service without disabling the remainder of the vehicle 12. A replacement sweeping deck can be easily substituted for a damaged one if necessary.

Dust wipers (e.g. elastomeric squeegees or brushes) 105 are mounted in front of each front wheel 28 to direct dust inwardly to the inside track of the front wheels 28. Thus the wheels 28 track through less dust and the dust is directed toward the sweeping deck and roller brush 90. The wipers may be mounted approximately 45° away from the line of travel to redirect the dust inwardly.

A rear seal assembly 104 includes a recirculation flap 106 and a rear flap 108 both mounted to a hook frame 110. The rear seal assembly 104 can then be suspended behind the sweeping deck and engaged onto a hanger hook 112 on the sub frame 84 which temporarily holds the rear seal assembly 104 in place until two retaining bolts or pins (not shown) are installed which secure the rear seal assembly 104 in its engaged position. The subassembly 104 can thus be easily removed and installed and the removed assembly 104 can be worked on away from the vehicle 12 in a convenient location rather than under the vehicle.

Figure 9:
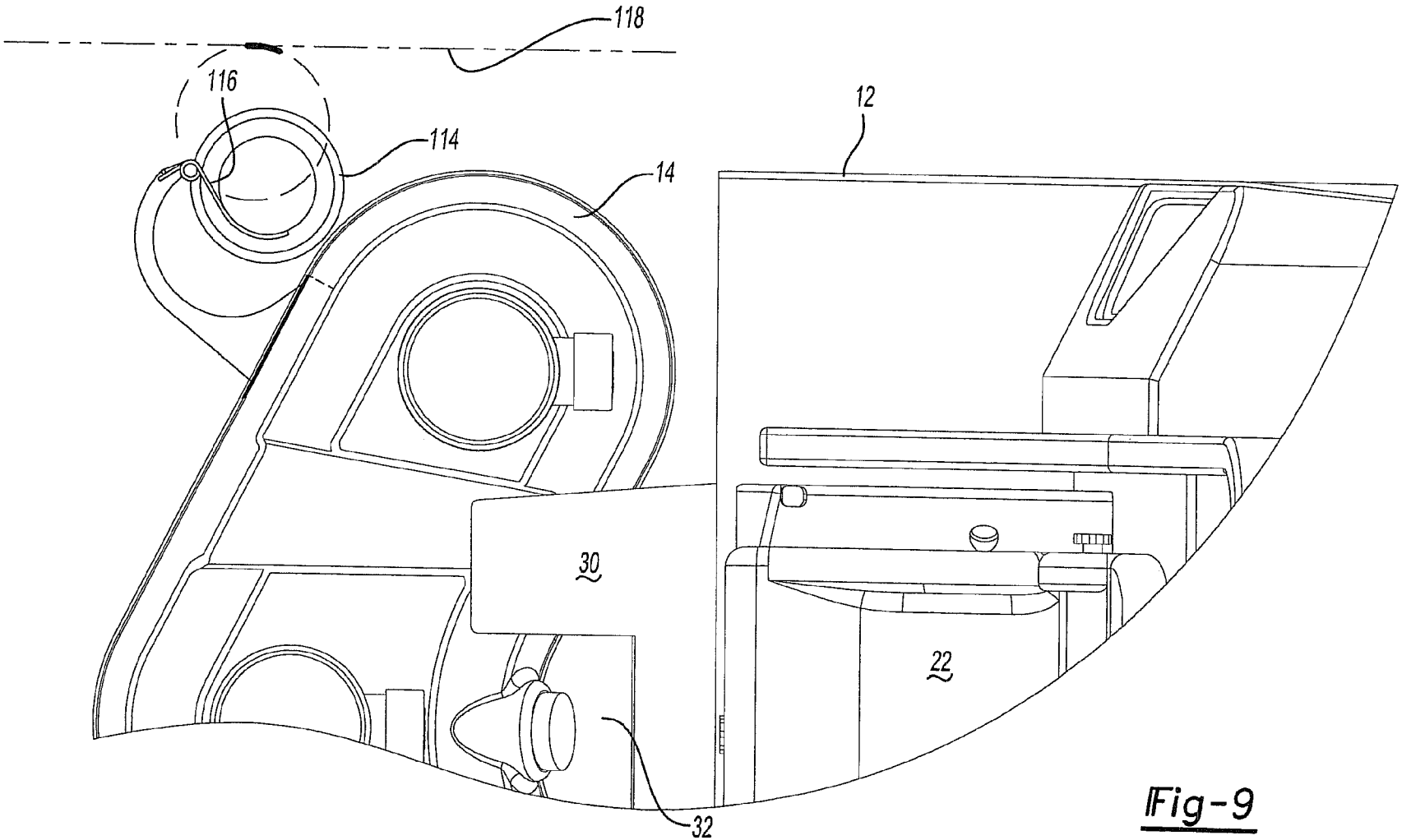
FIG. 9 is a fragmentary top plan view illustrating an optional edge grinder and polisher attached to the polishing and cleaning deck.

An optional edge grinder as shown in FIG. 9 can further increase the efficiency of the riding sander. The edge grinder attachment 114 is spring loaded through torsion spring 116 off of the deck 14 to be 100 percent retracted upon impact along a wall 118. Upon contact with the wall 118, the edge grinder retracts the necessary amount up to 100 percent retraction. The torsion spring allows retraction and recovery to its normal extended position without the need for the operator to stop production to reset anything.

The vehicle 12 also stores a clean water tank 120 and a recovery tank 122 at the rear end thereof. The clean water tank may either dispense water, a water cleaning solution mix or a densifier solution used during the grinding process. The solution uses gravity through a distribution bar mounted under the sweeping deck frame. The hopper entrance may be blocked and the sweeping brush becomes a rotary paint brush spreading the applied solution.

During a sequential grinding pass, the secondary vacuum applied to the hopper is turned off and an independent vacuum attached to the recovery tank is actuated picking up the slurry accumulated at the rear seal 108.

In addition an optional small separate pump can deliver water or water mist into or ahead of the grinding heads 36 to enhance the cutting action and extend the life of the cutters 72. This water delivery system also provides for the action of wet grinding. A rear squeegee 111 gathers up any remaining slurry and an appropriate positioned vacuum picks up the gathered slurry. This squeegee 111 eliminates the need for a separate wet grinding machine.

Figure 10:
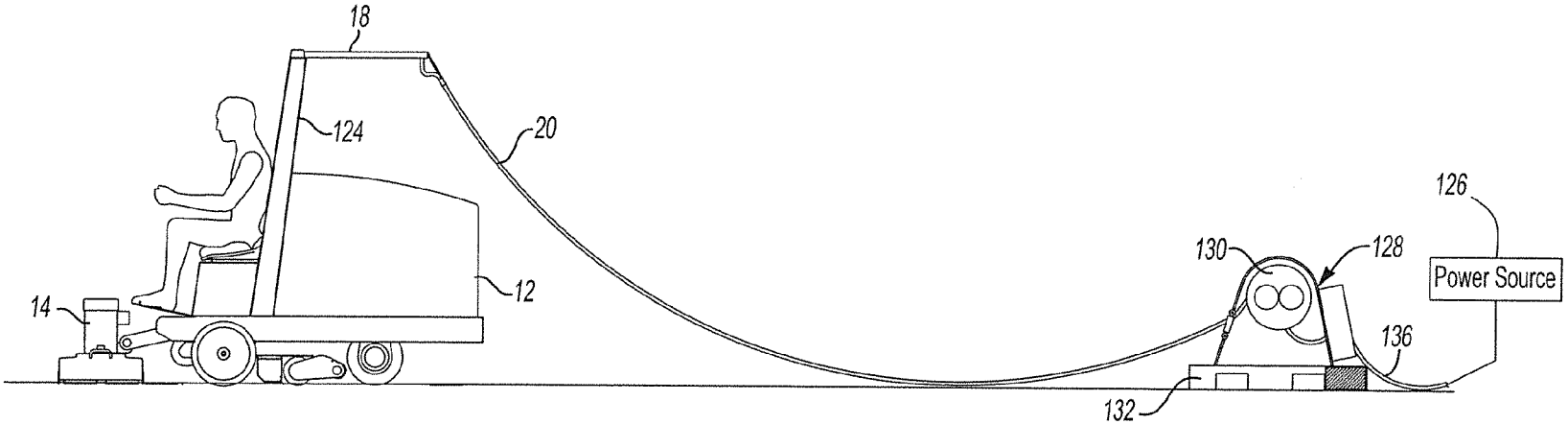
FIG. 10 is a side elevational view illustrating the power cord connection to a take up reel and power source.
Figure 11:
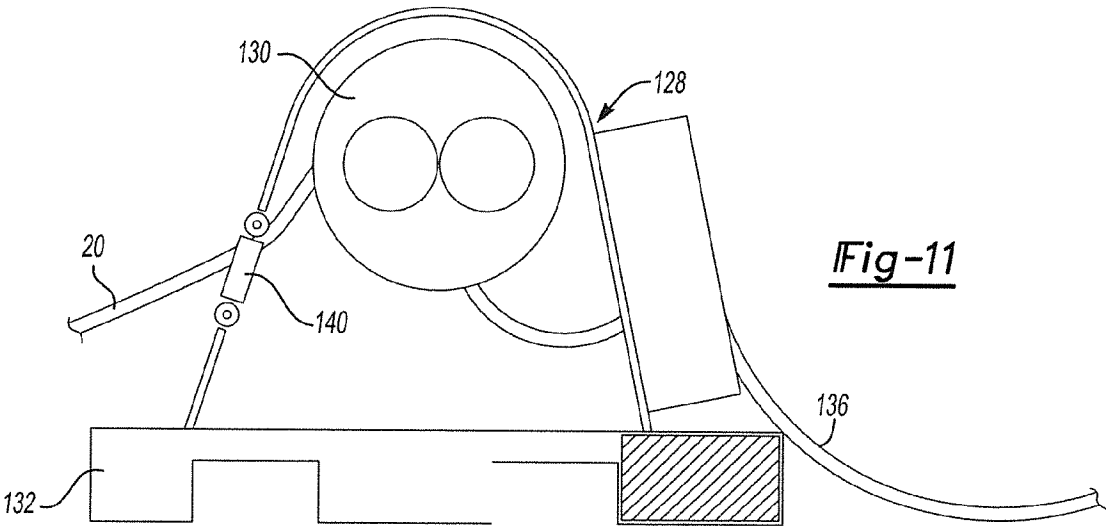
FIG. 11 is an enlarged side elevational view of the power cord reel shown in FIG. 10.

A power cord handling system is shown in FIGS. 1, and 10-12. The power cord is used to deliver power to the electric motors 38 of the heads 36 as well as for recharging the electric batteries 31 used to power the motor to drive the vehicle 12. The power cord 20 extends from a swing arm 18. The swing arm 18 is pivotably mounted from an upper central tower or arch 124. The swing arm normally extends rearwardly as shown in FIG. 10 when the vehicle is driven away from the power source 126 and a reel assembly 128 as shown in FIG. 10. As the vehicle is driven away, the reel rotates as the cord is unrolled therefrom. The reel assembly 128 as shown in FIG. 11 has a take up reel 130 pivotably mounted on a frame 132 that is weighted by weight base 134 that may have about 175 pounds of weight. The reel is spring loaded to be able to take up approximately 150 feet of power cord that contains four #6 flexible wires inside an abrasion resistant sheath of approximately ⅞" diameter. The weight is used to stabilize the reel assembly 128 against take up force of the spring against the full 150 feet of cord that produces about a 175 pound horizontal pull without sliding or tipping over. The reel assembly has a feed-in cord 136 from a power source such as an outdoor generator.

Figure 12:
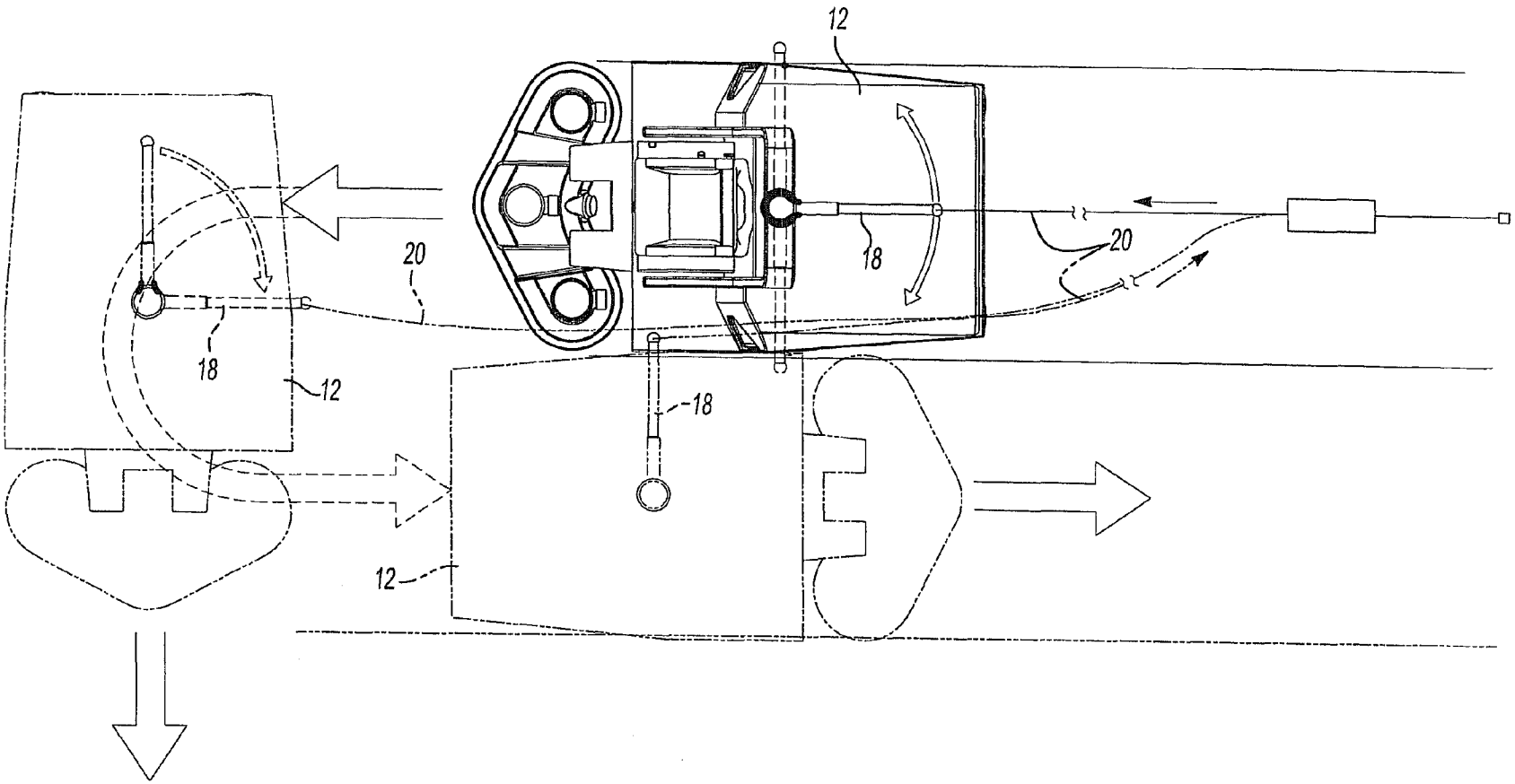
FIG. 12 is a top plan view schematically illustrating the position and motion of the riding polishing and cleaning apparatus and the swing arm during typical back and forth use of the riding polishing and cleaning apparatus.

As shown in FIG. 12, as the vehicle 12 moves away from the reel assembly, the swing arm extends rearwardly. As the vehicle 12 turns from the initial direction away from the reel, the swing arm is free to pivot to the side of the vehicle 12 to continue to point toward the reel. The swing arm is allowed to pivot up to approximately 90 degrees to either side as shown when the vehicle 12 is turned moving in a transverse direction. A stop member 137 on top of the arch 124 limits the motion to the 90 degrees such that when the vehicle returns in a direction toward the reel, the swing arm remains at the full left or right position. Furthermore, the reel automatically takes up slack cord as the vehicle 12 moves in a direction toward the reel and allows the power cord to be released as the vehicle moves away from the reel. The swing arm 18 has a dimension sufficiently great to extend beyond the left or right side of the vehicle 12 when it is in the full left or right position. In this manner, the power cord is retained off to the side of the vehicle 12 when the vehicle goes in a direction toward the reel. The positioning of the power cord automatically away from the front of the vehicle 12 provides the continuous operation of the vehicle 12 without the need for an operator to stop operating and manually move the power cord off to the side.

The swing arm may be fitted with a sensor so that if the arm sensor sends a torque above a predetermined amount between the two stops 137, a warning indicator such as a light or an alarm may be sounded to alert the operator that there is an undesirable condition with the reel, power cord or arm. The sensor may also if desired, be coupled to a deactuation device that safely interrupts the power to the main vehicle until the situation causing the excessive torque is eliminated.

The reel assembly 128 may also have a wiper 140 positioned to engage and wipe clean the power cord 20 as it is pulled from and reeled back into the reel assembly 128. This wiper 140 also further reduces the spread of free dust created by the deck 14.

Variations and modifications are possible without departing from the scope and spirit of the present invention as defined by the appended claims.

The embodiments in which an exclusive property or privilege is claimed are defined as follows:

1. A riding apparatus for treating a floor surface comprising:

a main motorized vehicle having steering and drive wheels and a forwardly located seat for an operator and left and right foot rests for feet of the operator;

a polishing and cleaning deck having a deck frame and a plurality of heads mounted to said deck frame and mounted in front of said vehicle and operably connected thereto to be moved thereby with a clearance formed between a front of said main motorized vehicle and a rear of said polishing and cleaning deck; and said left and right foot rests spaced apart to form a gap therebetween with said gap and said clearance aligned with said seat located for providing a line of sight for the operator from a position above said seat and when said operator is in a normal seated position on said seat through said gap and said clearance to see said floor surface between said polishing and cleaning deck and said main motorized vehicle directly behind said plurality of heads.

2. A riding apparatus for treating a floor surface as defined in claim 1 further comprising:

a low profile rear body section positioned to have its upper surface located below normal eye level of the operator when seated on said seat such that a 360° field of vision is directly available to an operator.

3. A riding apparatus for treating a floor surface as defined in claim 2 further comprising:

said upper surface being sloped downwardly from a position immediately behind said seat to a rear end of said riding apparatus.

4. A riding apparatus for treating a floor surface as defined in claim 3 further comprising:

an upper positioned swing arm pivotably connected about a substantially vertical pivot axis point behind and above said operator seat and constructed to horizontally swing left and right of a rearwardly extending position down a center line of said main motorized vehicle; and having a length more than one-half the width of said vehicle such that said swing arm has sufficient length to extend a restrained section of a power cord beyond a left and right side of said vehicle when swinging to its full left or right position; and said power cord having its restrained section near a distal end of said swing arm and operably connected to said polishing and cleaning decks for transferring electric power to said polishing and cleaning deck.

5. A riding apparatus for treating a floor surface as defined in claim 4 further comprising:

said pivot constructed to provide said swing arm to swing approximately 90° to either side of a centered rearwardly extending position.

6. A riding apparatus for treating a floor surface as defined in claim 5 further comprising:

said vehicle having two front wheels and a rear wheel; and said rear wheel being steerable and operably connected to an electric motor for driving said vehicle.

7. A riding apparatus for treating a floor surface as defined in claim 6 further comprising:

said electric motor powered by an on-board battery source; and said battery source being rechargeable via said power cord when plugged into a remote electric power source.

8. A riding apparatus for treating a floor surface as defined in claim 5 further comprising:

said polishing and cleaning deck being pivotably connected to said vehicle through a raisable link arm; and said polishing and cleaning deck being pivotably mounted to a front distal end of said raisable link arm along a generally horizontal laterally extending axis to pivot said deck to a generally vertical position to expose the underside of said polishing and cleaning deck when said polishing and cleaning deck is in a raised position off of said floor surface.

9. A riding apparatus for treating a floor surface as defined in claim 8 further comprising:

said raisable link arm having a notch at a distal end and a closable latch for being movable between a closed position to retain said deck to be pivotably mounted to said link arm and an open position to allow said link arm to vertically move and disengage from said polishing and cleaning deck when in its lower floor engaging position.

10. A riding apparatus for treating a floor surface as defined in claim 9 further comprising:

a sweeping deck mounted under said vehicle behind said polishing and cleaning deck through a linkage that allows for relative vertical movement of the sweeping deck with respect to said vehicle; and said sweeping deck comprises a motorized brush for sweeping a floor, a hopper for receiving dust from said brush and a castor wheel for providing a lower stop for said sweeping deck.

11. A riding apparatus for treating a floor surface as defined in claim 1 further comprising:

said vehicle having two front wheels and a rear wheel;

said rear wheel being operably connected to an electric motor for driving said vehicle; and said rear wheel being steerable for steering said vehicle.

12. A riding apparatus for treating a floor surface as defined in claim 1 further comprising:

said polishing and cleaning deck being pivotably connected to said vehicle through a raisable link arm; and said polishing and cleaning deck being pivotably mounted to a front distal end of said raisable link arm along a generally horizontal laterally extending axis to pivot said deck to a generally vertical position to expose the underside of said deck when said link arm is in a raised position off of said floor surface.

13. A riding apparatus for treating a floor surface as defined in claim 12 further comprising:

said raisable link arm having a notch at a distal end and a closable latch for being movable between a closed position to retain said polishing and cleaning deck to be pivotably mounted to said link arm and an open position to allow said link arm to vertically move and disengage from said polishing and cleaning deck when in its lower floor engaging position.

14. A riding apparatus for treating a floor surface as defined in claim 13 further comprising:

a sweeping deck mounted under said vehicle behind said polishing and cleaning deck through a linkage for relative vertical movement with respect to said vehicle; and said sweeping deck comprises a motorized brush for sweeping a floor, a hopper for receiving dust from said brush and a castor wheel for providing a lower stop for said sweeping deck.

15. A riding apparatus for treating a floor surface as defined in claim 1 further comprising:

a sweeping deck mounted under said vehicle behind said polishing and cleaning deck through a linkage for relative vertical movement with respect to said vehicle; and said sweeping deck comprises a motorized brush for sweeping a floor, a hopper for receiving dust from said brush and a castor wheel for providing a lower stop for said sweeping deck.

16. A riding apparatus for treating a floor surface as defined in claim 1 further comprising:

said polishing and cleaning deck having an edge grinder connected thereto to extend laterally therefrom to a wall or floor surface edge to polish and clean the edge of said floor surface.

17. A riding apparatus as defined in claim 1 further comprising:

a front facing seat positioned on a forward section of said main motorized vehicle having a seat surface at a position between 35" and 45" above said floor surface.

18. A riding apparatus for treating a floor surface as defined in claim 17 further comprising:

said polishing and cleaning deck being pivotably connected to said vehicle through a raisable link arm; and said polishing and cleaning deck being pivotably mounted to a front distal end of said raisable link arm along a generally horizontal laterally extending axis to pivot said deck to a generally vertical position to expose the underside of the plurality of heads of said polishing and cleaning deck when said link arm is in a raised position off of said floor surface.

19. A riding apparatus for treating a floor surface as defined in claim 18 further comprising:

said link arm having a notch at a distal end and a closable latch for being movable between a closed position to retain said deck to be pivotably mounted to said link arm and an open position to allow said link arm to vertically move and disengage from said polishing and cleaning deck when in its lower floor engaging position.

20. A riding apparatus for treating a floor surface as defined in claim 19 further comprising:

a sweeping deck mounted under said vehicle behind said polishing and cleaning deck through a linkage for relative vertical movement with respect to said vehicle; and said sweeping deck comprises a motorized brush for sweeping a floor, a hopper for receiving dust from said brush and a castor wheel for providing a lower stop for said sweeping deck.

21. A riding apparatus for treating a floor surface as defined in claim 17 further comprising:

a sweeping deck mounted under said vehicle behind said polishing and cleaning deck through a linkage for relative vertical movement with respect to said vehicle; and said sweeping deck comprises a motorized brush for sweeping a floor, a hopper for receiving dust from said brush and a castor wheel for providing a lower stop for said sweeping deck.

22. A riding apparatus for treating a floor surface comprising:

a main electric powered motorized vehicle having a steering and drive wheel and a forwardly located operator seat and a polishing and cleaning deck connected to the main electric power motorized vehicle;

an upper positioned swing arm for swinging in a substantially horizontal direction about a substantially vertical pivot axis and swinging motion extending rearwardly from said substantially vertical pivot axis having a length more than one half width of said vehicle sufficient to extend beyond a left and right side of said vehicle when swinging in a substantially horizontal direction to a respective full left and right position from a rearwardly extending center position about said substantially vertical pivot axis point behind and above said forwardly located operator seat; and a power cord having a restrained section being restrained near a distal end of said swing arm and operably connected to said polishing and cleaning deck for providing electric power to said polishing and cleaning deck.

23. A riding apparatus for treating a floor surface as defined in claim 22 further comprising:

said pivot constructed to provide said swing arm to swing approximately 90° to either side of the rearwardly extending center position.

24. A riding apparatus for treating a floor surface as defined in claim 23 further comprising:

said vehicle having two front wheels and a rear wheel; and said rear wheel being operably connected to an electric motor for driving said vehicle and being steerable.

25. A riding apparatus for treating a floor surface as defined in claim 22 further comprising:

said polishing and cleaning deck being pivotably connected to said vehicle through a raisable link arm; and said polishing and cleaning deck being pivotably mounted to a front distal end of said raisable link arm along a generally horizontal laterally extending axis to pivot said polishing and cleaning deck to a generally vertical position to expose the underside of said polishing and cleaning deck when said raisable link arm is in a raised position off of said floor surface.

26. A riding apparatus for treating a floor surface as defined in claim 25 further comprising:

said raisable link arm having a notch at a distal end and a closable latch for being movable between a closed position to retain said deck to be pivotably mounted to said raisable link arm and an open position to allow said link arm to vertically move and disengage from said polishing and cleaning deck when in its lower floor engaging position.

27. A riding apparatus for treating a floor surface as defined in claim 26 further comprising:

a sweeping deck mounted under said vehicle behind said polishing and cleaning deck through a linkage for relative vertical movement with respect to said vehicle; and said sweeping deck comprises a motorized brush for sweeping a floor, a hopper for receiving dust from said brush and a castor wheel for providing a lower stop for said sweeping deck.

28. A riding apparatus for treating a floor surface as defined in claim 22 further comprising:

a sweeping deck mounted under said vehicle behind said polishing and cleaning deck through a linkage for relative vertical movement with respect to said vehicle; and said sweeping deck comprises a motorized brush for sweeping a floor, a hopper for receiving dust from said brush and a castor wheel for providing a lower stop for said sweeping deck.

29. A riding apparatus for treating a floor surface having a main motorized vehicle body and a front mounted polishing and cleaning deck pivotably mounted for motion relative to said main motorized vehicle body and having a deck frame and a plurality of heads mounted to said deck frame; said riding apparatus further comprising:

a clearance gap formed between said deck frame and said main motorized vehicle body for providing a line of sight for an operator in a normal seated position on said main motorized vehicle through said clearance gap to see said floor surface along a centerline of said motorized vehicle body directly behind a portion of the deck frame and directly behind all of said plurality of heads;

a sweeping deck mounted under said vehicle body behind said polishing and cleaning deck through a linkage system for relative vertical movement with respect to said vehicle body;

said sweeping deck comprises a motorized brush for sweeping a floor, a hopper for receiving dust from said brush and a castor wheel for providing a lower stop for said sweeping deck;

said sweeping deck having a rear seal behind said brush;

said rear seal connected to a subassembly that hangs on a hanger hook and can be removed therefrom; and pull pins engage through the hanger hook and assembly to lock said rear seal in place.

30. A riding apparatus as defined in claim 29 further comprising:

said hopper being operably connected to a vacuum source for emptying said hopper of dust.

31. A riding apparatus as defined in claim 30 further comprising:

said hopper having a closure for closing said hopper for wet scrubbing to prevent wet slurry from entering said hopper.

32. A riding apparatus as defined in claim 29 further comprising:

said linkage system includes a lifting actuator to raise said sweeping deck and when in a floor engaging position allows said sweeping deck to lift with respect to said vehicle body when encountering a raised said floor surface or obstacle under said vehicle body wheels.

33. A riding apparatus as defined in claim 29 further comprising:

said motorized brush having an adjustment mechanism for adjusting it closer to the floor surface as it wears and its diameter decreases.

34. A riding apparatus as defined in claim 29 further comprising:

dust wipers positioned in front of two front wheels of said main motorized vehicle body and abutting said floor surface for directing dust to between said front wheels.

35. A riding apparatus for treating a floor surface having a main motorized vehicle body and a front mounted polishing and cleaning deck pivotably mounted for motion relative to said main motorized vehicle body and having a deck frame and a plurality of heads mounted to said deck frame; said riding apparatus further comprising:

a clearance gap formed between said deck frame and said main motorized vehicle body for providing a line of sight for an operator in a normal seated position on said main motorized vehicle through said clearance gap to see said floor surface along a centerline of said motorized vehicle body directly behind a portion of the deck frame and directly behind all of said plurality of heads;

a sweeping deck mounted under said vehicle body behind said polishing and cleaning deck;

said sweeping deck comprising a motorized brush for sweeping a floor, a hopper for receiving dust from said brush and a castor wheel for providing a lower stop for said sweeping deck;

said brush constructed for wet and dry brushing applications on said floor surface said sweeping deck having a rear seal behind said brush;

said rear seal connected to a subassembly that hangs on a hanger hook and can be removed therefrom; and pull pins engage through the hanger hook and assembly to lock said rear seal in place.

36. A riding apparatus for treating a floor surface comprising:

a main motorized vehicle having steering and drive wheels and a seat for an operator;

a polishing and cleaning deck having a deck frame and a plurality of heads mounted to said deck frame, said polishing and cleaning deck mounted in front of said vehicle and operably connected thereto to be moved thereby; and said polishing and cleaning deck having an edge grinder pivotably mounted thereto about a vertical axis and extends laterally therefrom to a wall or floor surface edge to polish and clean the edge of said floor surface said edge grinder is horizontally laterally movable with respect to said polishing and cleaning deck and is spring biased laterally outward.

37. A riding apparatus for treating a floor surface having a main motorized vehicle body and a front mounted polishing and cleaning deck having a deck frame pivotably mounted for motion relative to said main motorized vehicle body and a plurality of heads connected to said deck frame and mounted in front of said main motorized vehicle body with a clearance gap therebetween, said riding apparatus further comprising:

a forwardly located seat for an operator for providing a line of sight for the operator from a position above said seat and when the operator is in a normal seated position on said seat through said clearance gap to see said floor surface between said polishing and cleaning deck and said main motorized vehicle body along a centerline of said motorized vehicle body directly behind a portion of the deck frame and directly behind all of said plurality of heads;

a water tank and on board delivery system to deliver water in proximity with said polishing and cleaning deck for wet grinding;

a rear squeegee for gathering said water to one area;

a vacuum pick up system for picking up said water after being used with said polishing and cleaning deck;

a holding tank for holding said water; and a power brush mounted under the main motorized vehicle body constructed to be used for wet use and for dry use.

* * * * *